US007306475B2

(12) United States Patent
Tsuruta

(10) Patent No.: US 7,306,475 B2
(45) Date of Patent: Dec. 11, 2007

(54) ELECTRICAL CONNECTION CONSTRUCTION

(75) Inventor: Satoshi Tsuruta, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/712,187

(22) Filed: Feb. 28, 2007

(65) Prior Publication Data

US 2007/0207652 A1 Sep. 6, 2007

(30) Foreign Application Priority Data

Mar. 3, 2006 (JP) ..... 2006-058391

(51) Int. Cl.
*H01R 13/627* (2006.01)

(52) U.S. Cl. ..... 439/364

(58) Field of Classification Search ..... 439/364, 439/362, 801, 883, 926; 310/71
See application file for complete search history.

(56) References Cited

U.S. PATENT DOCUMENTS 3,636,502 A * 1/1972 Wallace ..... 439/626
6,664,678 B2 * 12/2003 Shimizu ..... 310/71
7,002,271 B2 * 2/2006 Reed et al. ..... 310/71

FOREIGN PATENT DOCUMENTS

JP 2001-025187 1/2001

* cited by examiner

*Primary Examiner*—Phuong Dinh
(74) *Attorney, Agent, or Firm*—Gerald E. Hespos; Anthony J. Casella

(57) ABSTRACT

Power feed terminals (50) are held in movable side housings (20), and intermediate terminals (40) are held in a waiting side housing (10). Each intermediate terminal (40) includes a power-feed side contact (42) and a motor side contact (44). A connection surface (12BS) of the waiting side housing (10) is exposed at the outer surface of a motor casing (90), and the power-feed side contacts (42) of the intermediate terminals (40) are exposed in the connection surface (12BS) of the waiting side housing (10). By connecting the housings (10, 20), contacts (51) of the power feed terminals (50) are placed on the power-feed side contact portions (42) and bolts (60) are inserted through these contacts placed one over the other to fix the terminals (40, 50) together.

7 Claims, 8 Drawing Sheets

ELECTRICAL CONNECTION CONSTRUCTION

BACKGROUND OF THE INVENTION

1. Field of the Invention

The invention relates to an electrical connection construction for a motor.

2. Description of the Related Art

Japanese Unexamined Patent Publication No. 2001-25187 discloses a means for connecting a power supply cable to a motor in a hybrid vehicle or the like that uses a combination of an engine and a motor as a source of power. The connector has a motor side terminal connected with an end of a motor conductor from a stator coil. A power feed terminal of a power feed cable is placed on the motor side terminal and the two terminals are fixed by a bolt. The bolt provides good connection reliability by strongly pressing both terminals together.

The above-described connection case requires the bolt insertion holes of the power feed terminal and the motor side terminal to be aligned. The terminals then must be fixed by hand so as not to move while keeping an aligned state. The bolt then must be inserted through both bolt insertion holes. The bolt inserting operation becomes burdensome if the bolt insertion holes are displaced from each other during the operation.

The invention was developed in view of the above problem and an object thereof is to efficiently connect a power feed terminal to a motor side terminal.

SUMMARY OF THE INVENTION

The invention relates to an electrical connection construction for connecting at least one power feed terminal with at least one motor side terminal. The construction comprises a movable side housing holding the power feed terminal, a waiting side housing connectable with the movable side housing, and at least one intermediate terminal. The intermediate terminal includes at least one motor side contact to be connected with the motor side terminal and at least one power-feed side contact to be connected with the power feed terminal. A connection surface of the waiting side housing is exposed and the power-feed side contact is exposed at the connection surface of the waiting side housing. A contact of the power feed terminal is placed on the power-feed side contact by connecting the waiting side housing and the movable side housing. At least one fastener is inserted through the contacts to fix the power feed terminal and the intermediate terminal to each other.

The intermediate terminal held at the waiting side housing includes the motor side contact and the power-feed side contact. The two housings are connected with the connection surface of the movable side housing opposed to that of the waiting side housing. The contact of the power feed terminal held in the movable side housing is placed on the power-feed side contact of the intermediate terminal, and the fastener is inserted through the contacts placed one over the other to fix the two terminals to each other. Thus, the contact position of the intermediate terminal and the power feed terminal can be positioned precisely by the connecting operation of the two housings prior to the fixing by the fastener. As a result, the power feed terminal can be connected easily and quickly with the motor side terminal via the intermediate terminal. Accordingly, overall operability of the connection construction is improved.

The waiting side housing preferably is mounted to a motor casing, and the connection surface of the waiting side housing is exposed at the outer surface of the motor casing.

The intermediate terminal held in the waiting side housing and includes the motor side contact and the power-feed side contact. The two housings are connected with the connection surface of the movable side connector opposed to that of the waiting side housing. The contact of the power feed terminal in the movable side housing is placed on the power-feed side contact of the intermediate terminal. The bolt is inserted through the contacts placed one over the other to fix the two terminals together. Thus, the contact position of the intermediate terminal and the power feed terminal can be positioned precisely by connecting the two housings prior to the fixing by the bolt. As a result, the power feed terminal can be connected easily and quickly with the motor side terminal via the intermediate terminal.

A through hole preferably penetrates the movable side housing in a connecting direction of both housings to make an opening in a connection surface of the movable side housing. The contact of the power feed terminal preferably is arranged across the through hole at an intermediate position of the through hole with respect to the penetrating direction.

The end surface of the through hole opposite to the connection surface preferably is left open, and an operation space communicates with the through hole for operating the fastener. Thus, the fastener can be tightened efficiently and smoothly from a direction opposite to the connection surface.

The power feed terminal and the intermediate terminal preferably are partly resin-coated except the contact portions with other terminals. Thus, these terminals are protected in the corresponding housings.

The motor side terminal preferably is connected with the motor side contact of the intermediate terminal via at least one busbar, and at least one of the motor side terminal and the busbar includes an error compensating portion capable of compensating a displacement of the other with the busbar fixed to the intermediate terminal.

The intermediate terminal is fixed in the waiting side housing and the waiting side housing is mounted in the motor casing. The intermediate terminal and the motor side terminal may be displaced from each other due to a dimensional error or the like. The prior art arrangement requires movement of the motor side terminal towards the intermediate terminal to achieve the required alignment. However, the motor side terminal is connected with a motor coil or the like and cannot be repositioned freely. Accordingly, the subject invention has the busbar between the motor side terminal and the intermediate terminal. One of the motor side terminal and the busbar includes the error compensating portion that compensates for the displacement. Thus, the motor side terminal can be connected to the intermediate terminal without changing the position thereof. As a result, the two terminals can be connected reliably. Thus, the overall operability of the connection construction is improved.

The motor side terminal and the busbar preferably have insertion holes for another fixing member in parts to be placed at least partly one over the other. One insertion hole of the motor side terminal and the busbar preferably is an oblong hole extending towards and away from the intermediate terminal. The oblong hole forms the error compensating portion. Thus, the connecting position of the motor side terminal and the busbar can be adjusted easily within the formation range of the oblong hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

An electrical connection construction in accordance with the invention is illustrated in FIGS. 1 to 8 and is intended for supplying power to a motor installed in a hybrid vehicle or the like. The construction is used with a motor casing 90 made of metal or alloy for accommodating a stator of an unillustrated motor. A mount hole 91 penetrates a wall of the motor casing 90 vertically along an extension direction ED to provide communication between the inside and outside of the motor casing 90.

A step 92 is formed substantially in a middle part of the mount hole 91 of the motor casing 90 along the extension direction ED of the hole surface. An upper opening above the step 92 has a large diameter and a lower opening below the step 92 has a small diameter. A waiting side housing 10 is fit into the mount hole 91 of the motor casing 90 from above and along the extension direction ED. The waiting side housing 10 is made of e.g. a synthetic resin that is molded unitarily around three intermediate terminals 40 in an insert molding process. Thus, the intermediate terminals 40 are surrounded and supported by a unitary matrix of the resin. The intermediate terminals 40 correspond respectively to the respective phases of a three-phase motor.

Figure 5:
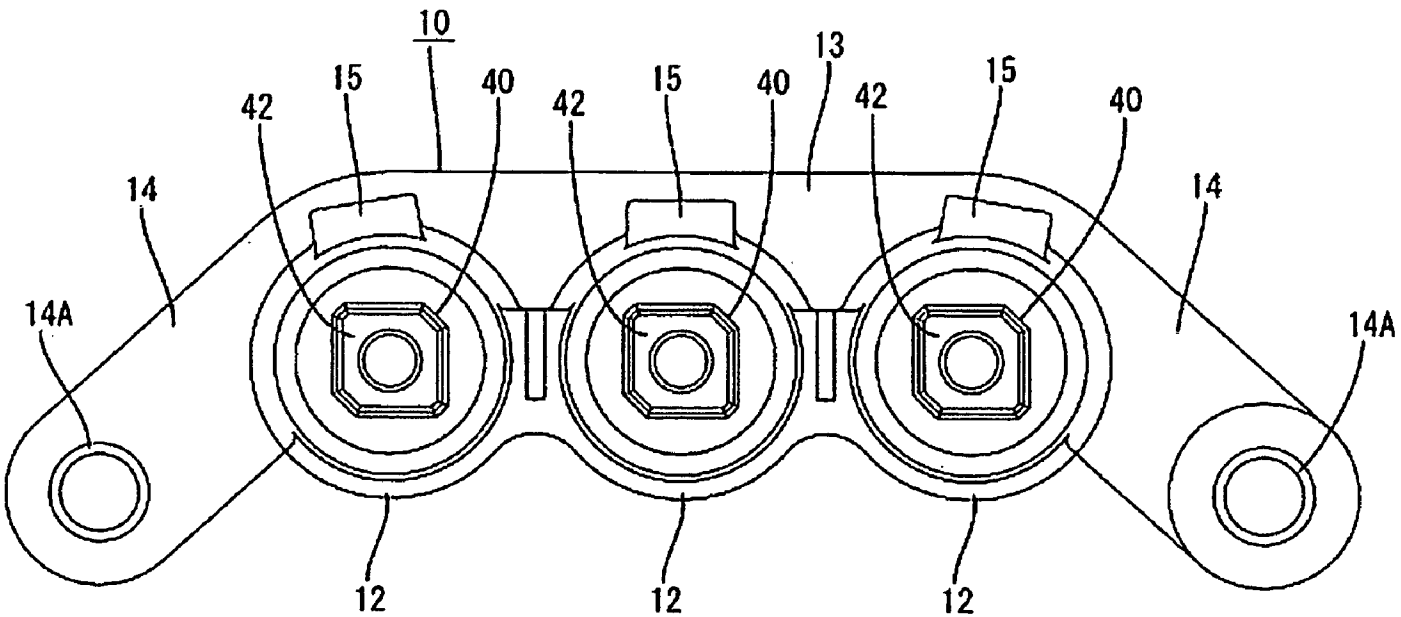
FIG. 5 is a plan view of the waiting side connector housing.

Each intermediate terminal 40 is made of an electrically conductive metal material and is narrow and long vertically along the extension direction ED. The upper or rear end of each intermediate terminal 40 has a bottomed tightening hole 41 that extends coaxially in the extension direction ED. An internal thread is formed in at least one part of the inner circumferential surface of the tightening hole 41 and corresponds to the external thread of a bolt 60. A contact 51 of a power feed terminal 50 is connected to the intermediate terminal 40 by being placed on the upper end of the intermediate terminal 40 to form a power-feed side contact 42. A first bolt insertion hole 43 penetrates a bottom end of the intermediate terminal 40 below the bottom end of the tightening hole 41 in a direction substantially normal to an extending direction ED of the tightening hole 41. An internal thread is formed in at least part of the inner circumferential surface of the first bolt insertion hole 43 over substantially the entire length. A busbar 70 is held in contact with an opening edge (left side in FIG. 1) of the first bolt insertion hole 43 to form a motor side contact 44. The motor side contact 44 is inside the motor casing 90, whereas the power-feed side contact 42 is outside the motor casing 90. Ribs 45 are formed circumferentially in a longitudinal middle part of the outer circumferential surface of the intermediate terminal 40 and function to retain the waiting side housing 10. As shown in FIG. 5, each intermediate terminal 40 has an asymmetrical polygonal shape in plan view, which is structurally identifiable. Thus, the intermediate terminal 40 can be connected with the mating power feed terminal 50 in a specified position and is prevented from turning.

Figure 6:
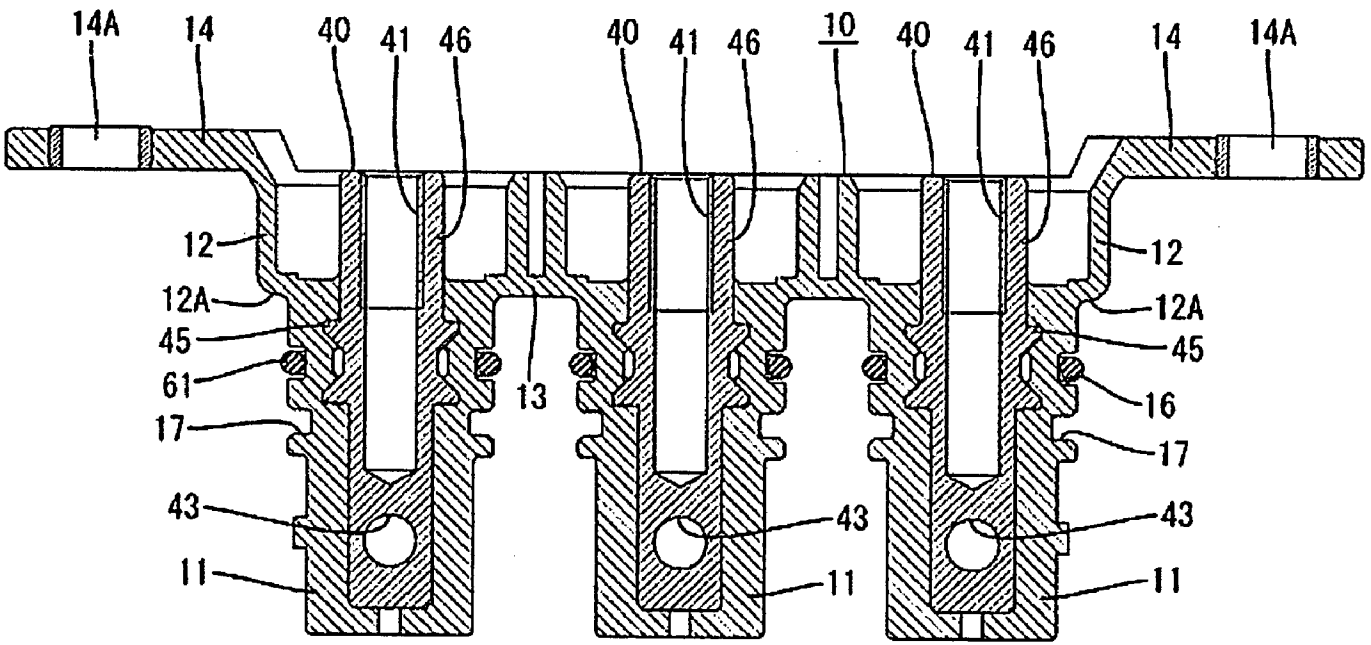
FIG. 6 is a vertical section of the waiting side connector housing.

As shown in FIG. 6, the waiting side housing 10 has three substantially transversely arranged mold portions 11 extending vertically along the extension direction ED. Each mold portion 11 defines a unitary matrix of resin that surrounds and engages an intermediate part of the respective intermediate terminals 40. Three transversely arranged fitting recesses 12 are connected with the corresponding mold portions 11. The fitting recesses 12 are cross-sectionally larger than the mold portions 11 and open in the upper surface of the waiting side housing 10. A coupling 13 unitarily joins the upper ends of the respective fitting recesses 12 to each other. Mounts 14 project transversely from the opposite lateral ends of the coupling 13 and can be brought into contact with portions of the outer surface of the motor casing 90 adjacent the mount hole 91. The mounts 14 are fixed to the motor casing 90 by inserting bolts (not shown) through bolt holes 14A in the mounts 14. Three substantially rectangular recesses 15 are formed at positions of the upper surface of the coupling 13 substantially continuous with the opening edges of the upper surfaces of the respective fitting recesses 12, as shown in FIG. 5. The back wall of each fitting recess 12 has a jaw 12A bulging out sideways from the outer circumferential surface of the mold portion 11. The jaw 12A can be placed in contact with the step 92 of the mount hole 91 of the motor casing 90. The respective fitting recesses 12 have substantially the same shape and/or size and are substantially cylindrical. Upper ends of the intermediate terminals 40, including the power-feed side contacts 42 project up along the extension direction ED from substantially central parts of the bottom surfaces 12BS of the fitting recesses 12 and are exposed inside the fitting recesses 12. The power-feed side contacts 42 of the intermediate terminals 40 are at substantially the same height as the outer surface of the motor casing 90 and the open upper ends of the fitting recesses 12.

A seal groove 16 is formed circumferentially in an intermediate part along the extension direction ED of the outer circumferential surface of each mold portion 11 and can receive a seal ring 61. The seal rings 61 provide a fluid tight seal between the outside and inside of the motor casing 90. A receiving groove 17 is formed in the outer circumferential surface of each mold portion 11 at a position more inward than the seal ring 16. The receiving grooves 17 are located below and adjacent the inner surface of the motor casing 90 when the waiting side housing 10 is mounted into the mount hole 91 of the motor casing 90. Further, a substantially rectangular auxiliary wall 18 is formed along the plate surface of the intermediate terminal 40 substantially opposite the motor side contact 44 and at a part of the outer circumferential surface of each mold portion 11 corresponding to an exit side of the first bolt insertion hole 43 of the intermediate terminal 40. The auxiliary wall 18 covers the intermediate terminal 40 except the motor side contact portion 44. Further, a second bolt insertion hole 19 penetrates the auxiliary wall 18 in the thickness direction and communicates with the first bolt insertion hole 43. A corresponding bolt 62 can be inserted loosely into the first and second bolt insertion holes 43, 19.

Figure 1:
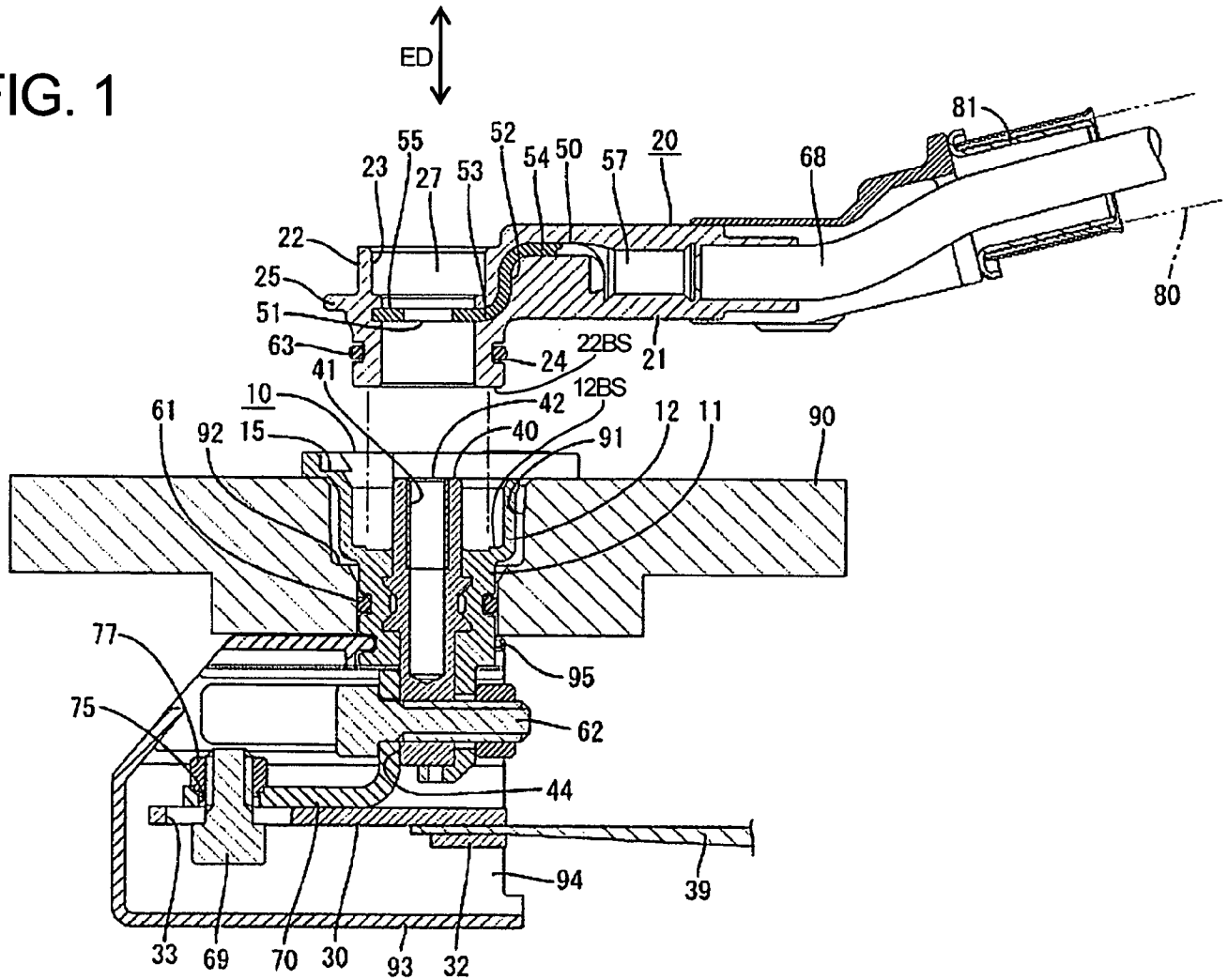
FIG. 1 is a side view in section showing a state before movable the housings are assembled with a waiting side housing in one embodiment.
Figure 7:
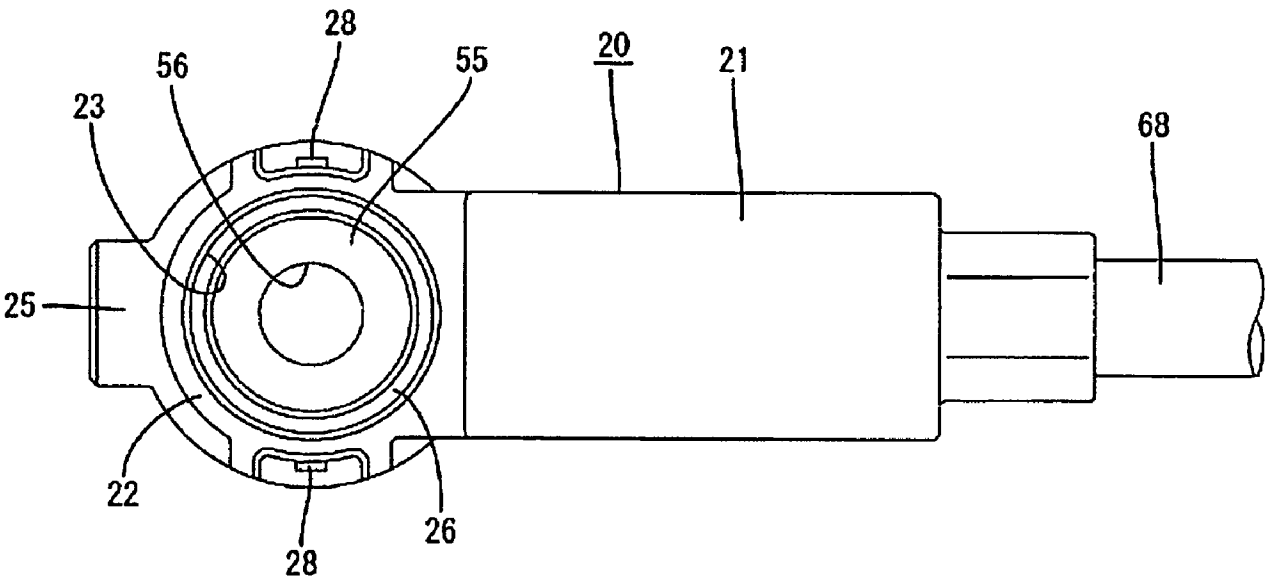
FIG. 7 is a plan view of the movable side connector housing.

Movable side housings 20 correspond to the respective fitting recesses 12 of the waiting side housing 10. The movable side housings 20 are molded from synthetic resin and a power feed terminal 50 is an insert in the molding process. Thus, part of each power feed terminal 50 is surrounded by a unitary matrix of the synthetic resin that defines the movable side housing 20. More specifically, as shown in FIGS. 1 and 7, the movable side housing 20 has a flat shape and includes a housing main body 21 arranged substantially horizontally and normal to the extension direction ED. A substantially cylindrical fitting 22 is continuous with the front end (left in FIG. 1) of the housing main body 21 and has an axis that extends substantially vertically along the extension direction ED. The housing main body 21 is mounted substantially along the outer surface of the motor casing 90 and the fitting portion 22 is at fit into the corresponding fitting recess 12. A through hole 23 penetrates the fitting 22 along the axis line, and a seal groove 24 is formed around the outer circumferential surface of the fitting 22. A seal ring 63 is mounted in the seal groove 24 and closely contacts the inner circumferential surface of the fitting recess 12 when the two housings 10, 20 are connected to provide fluid tight sealing between the two housings 10, 20.

A projection 25 projects forward from the front of the outer circumferential surface of the fitting 22, and the movable side housing 20 is positioned relative to the waiting side housing 10 by closely engaging the projection 25 with the corresponding recess 15 of the waiting side housing 10 so as not to move loosely. Further, the movable side housing 20 can be connected with the waiting side housing 10 by holding this projecting piece 25.

An opening edge at the bottom end of the fitting 22 can contact the bottom surface of the fitting recess 12, and the bottom end surface 22BS of the fitting 22 is a connection surface of the movable side housing 20. On the other hand, the through hole 23 is widened at a step 26 formed at an intermediate position with respect to the extension direction ED of the through hole 23, so that the upper end of the fitting 22 defines an operation space 27 with larger diameter opening than the bottom end. A head of the bolt 60 is accommodated in the operation space 27 to enable a smooth bolt tightening operation.

A cap 64 made e.g. of synthetic resin is mounted on the fitting 22 from above and along the extension direction ED. Left and right locking projections 28 are provided on opposite circumferential end positions of the outer circumferential surface of the fitting 22, and are engageable with resilient locking pieces (not shown) of the cap 64. The cap 64 is a substantially round lid capable of closing the open upper end of the fitting 22, and a tubular portion of the cap 64 is fit into the operation space 27 in the fitting 22. A flange 65 bulges around the outer circumferential surface of the upper end of the cap 64, and can be placed in contact with the opening edge at the upper end of the fitting recess 12. A seal groove 66 is formed around the outer circumferential surface of the cap 64, and a seal ring 67 is mounted in this seal groove 66. The seal ring 67 closely contacts the inner circumferential surface of the through hole 23 when the cap 64 is mounted to provide a fluid tight seal.

The power feed terminal 50 is made long and narrow in forward and backward directions by working an electrically conductive metal. A coupling 52 is at an intermediate position of the power feed terminal 50. A terminal side connecting portion 53 is arranged substantially horizontally and normal to the extension direction ED before the coupling 52. A cable side connecting portion 54 is arranged substantially horizontally and normal to the extension direction ED after the coupling 52.

The terminal side connecting portion 53 has a connection main body 55 exposed in the through hole 23 at a position slightly below the step 26. The lower surface of the connection main body 55 defines a contact 51 of the power feed terminal 50 and the peripheral edge of the connection main body 55 is coated in the fitting 22 by molding. A bolt insertion hole 56 penetrates the connection main body 55 vertically along the extension direction ED and is substantially coaxially with the through hole 23. The connection main body 55 is placed on the power-feed side contact 42 defined at the upper end of the intermediate terminal 40 when the housings 10, 20 are connected so that the bolt insertion hole 56 aligns with the tightening hole 41 of the intermediate terminal 40.

The coupling 52 and the cable side connecting portion 54 of the power feed terminal 50 are coated in the housing 21 by molding. A barrel-shaped crimping portion 57 is formed at the rear end of the cable side connecting portion 54 and is crimped, bent or folded into connection with a power feed cable 68. An end of the power feed cable 68 is coated in the housing main body 21 by molding and the remaining part thereof is drawn out backward from the rear end of the housing main body 21.

Three power feed cables 68 drawn out from the housing main bodies 21 are surrounded together by a shield 80 in the form of a flat tubular braided wire. An end of the shield 80 is connected with a shielding tube 81 that is connected with a shielding shell 82 closely mounted on the outer surfaces of the movable side housings 20. This shielding shell 82 is fixed to the outer surface of the motor casing 90 by bolts (not shown) while enclosing the movable side housings 20.

Figure 8:
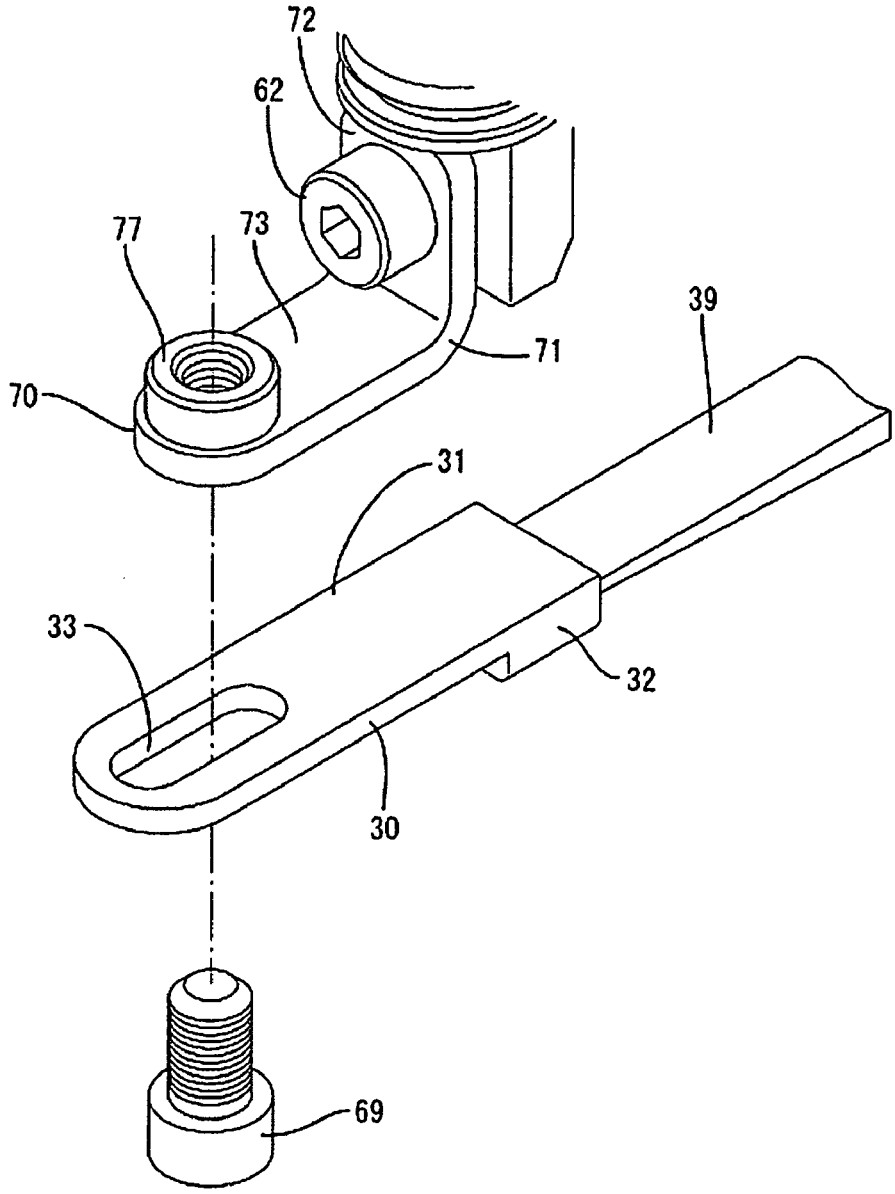
FIG. 8 is an exploded perspective view showing a state before a motor side terminal and a busbar are assembled.

The motor side terminal 30 is made of electrically conductive metal and includes a connecting main portion 31 with substantially flat plate surfaces arranged substantially horizontal and normal to the extension direction ED. A barrel-shaped fixing portion 32 is continuous with the rear of the connecting main portion 31, as shown in FIG. 8, and is crimped, bent or folded into connection with an end of a motor conductor 39 e.g. from a stator coil (not shown).

The motor side terminal 30 is connectable with the intermediate terminal 40 in substantially in forward and backward directions by interposing the busbar 70 between the motor side terminal 30 and the intermediate terminal 40. The busbar 70 is bent to have a substantially L-shape in side view and includes a substantially vertical portion 72 and a substantially horizontal portion 73 at opposite sides of a bent portion 71. The vertical portion 72 can contact the motor side contact 44 at the entrance side of the first bolt insertion hole 43 of the intermediate terminal 40 and has a third bolt insertion hole 74 that communicates with the first bolt insertion hole 43. The first, second and third bolt insertion holes 43, 19, 74 communicate substantially coaxially with each other horizontally in a direction substantially normal to the extension direction ED. The horizontal portion 73 is placed on the upper surface of the connecting main portion 31 of the motor side terminal 30 and has a fourth bolt insertion hole 75 penetrating in a thickness direction. A nut 77 is fixed at a position of the upper surface of the horizontal portion 73 corresponding to the circumference of the fourth bolt insertion hole 75.

The connecting main portion 31 of the motor side terminal 30 is formed with an oblong hole 33 that communicates with the fourth bolt insertion hole 75 of the busbar 70 and extends substantially straight in forward and backward directions towards and away from the intermediate terminal 40. The busbar 70 is fixed to the motor side terminal 30 at a suitable position in the length range of the oblong hole 33 by a bolt 69. Thus, the vertical portion 72 and the motor side contact 44 can be connected in surface contact.

The connection construction for the motor side terminal 30 is enclosed by the cover 93. The cover 93 is made e.g. of synthetic resin and defines a cap having an open rear surface. Partition walls 94 project inside the cover 93 for partitioning the transversely adjacent mold portions 11, and the upper and bottom ends of the partition walls 94 are joined unitarily to the inner surfaces of the upper and bottom walls of the cover 93. Recesses 95 are formed in the upper wall of the cover 93 along the receiving grooves 17 of the mold portions 11 of the waiting side housing 10 and open at the rear end of the upper wall. The cover 93 is mounted on the waiting side housing 10 by fitting the edges of the recesses 95 into the receiving grooves 17. The upper wall of the cover 93 is arranged along the inner surface of the motor casing 90 when the cover 93 is mounted to avoid an undesirable electrical contact of the electrically conductive busbars 70, intermediate terminals 40 and motor side terminals 30 in the cover 93 with the motor casing 90. Windows are formed for the respective terminals in the front wall of the cover 93 so that the inside of the cover 93 can be seen from the outside.

The connection construction is made initially by molding the resin of the connection main bodies 55 around areas of the power feed terminals 50 except the connection main bodies 55 to form an integral insert molded assembly of the movable side housings 20 and the power feed terminals 50. Similarly, the resin of the waiting side housing 10 is molded around areas of the intermediate terminals 40 except the motor side contacts 44 and the power-feed side contacts 42 to form an integral insert molded assembly of the waiting side housing 10 and the intermediate terminals 40. The waiting side housing 10 then is fit into the mount hole 91 of the motor casing 90 along the extension direction ED as if being dropped from above and is bolted to the motor casing 90 to bring the mounts 14 into contact with the outer surface of the motor casing 90. In this state, the open upper ends of the fitting recesses 12 are at the outer surface of the motor casing 90, the upper ends (including the power-feed side contacts 42) of the intermediate terminals 40 project up towards the outside in an exposed manner, and the bottom ends of the mold portions 11 and the auxiliary walls 18 are inside the motor casing 90 while exposing the motor side contacts 44 of the intermediate terminals 40.

The horizontal portions 73 of the busbars 70 then are placed on the upper surfaces of the connecting main portions 31 of the motor side terminals 30 and the oblong holes 33 of the motor side terminals 30 and the fourth bolt insertion holes 75 are aligned to communicate with each other. In this state, the connecting positions of the busbars 70 to the motor side terminals 30 are adjusted, the vertical portions 72 of the busbars 70 are held in surface contact with the motor side contacts 44 of the intermediate terminals 40 and the bolts 69 are inserted through the oblong holes 33 and the fourth bolt insertion holes 75. The bolts 69 then are screwed into the nuts 77 to fix the busbars 70 to the motor side terminals 30. The third bolt insertion holes 74 of the busbars 70 communicate with the first bolt insertion holes 43 of the intermediate terminals 40 when the vertical portions 72 of the busbars 70 contact the motor side contacts 44 of the intermediate terminals 40. Thus, the bolts 62 are inserted into the third bolt insertion holes 74, the first bolt insertion holes 43 and the second bolt insertion holes 19. Nuts 78 are arranged on the auxiliary walls 18 of the mold portions 11 around the exit sides of the second bolt insertion holes 19. The bolts 62 are screwed into the nuts 78 to secure the vertical portions 72 of the busbars 70, the intermediate terminals 40 and the auxiliary walls 18 in thickness direction (forward and backward directions).

Figure 2:
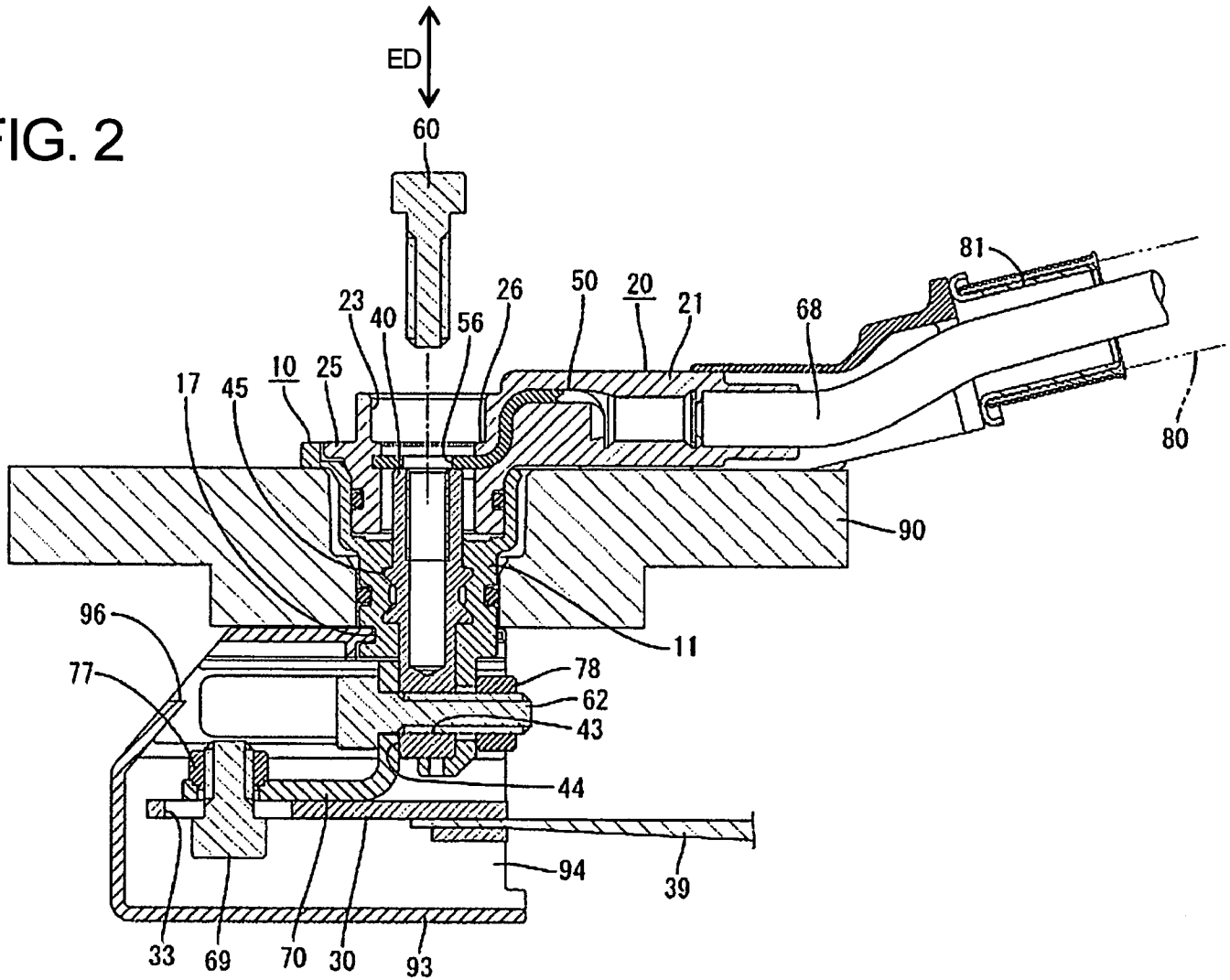
FIG. 2 is a side view in section showing a state before bolt tightening the connected movable side housings and the waiting side housing.
Figure 3:
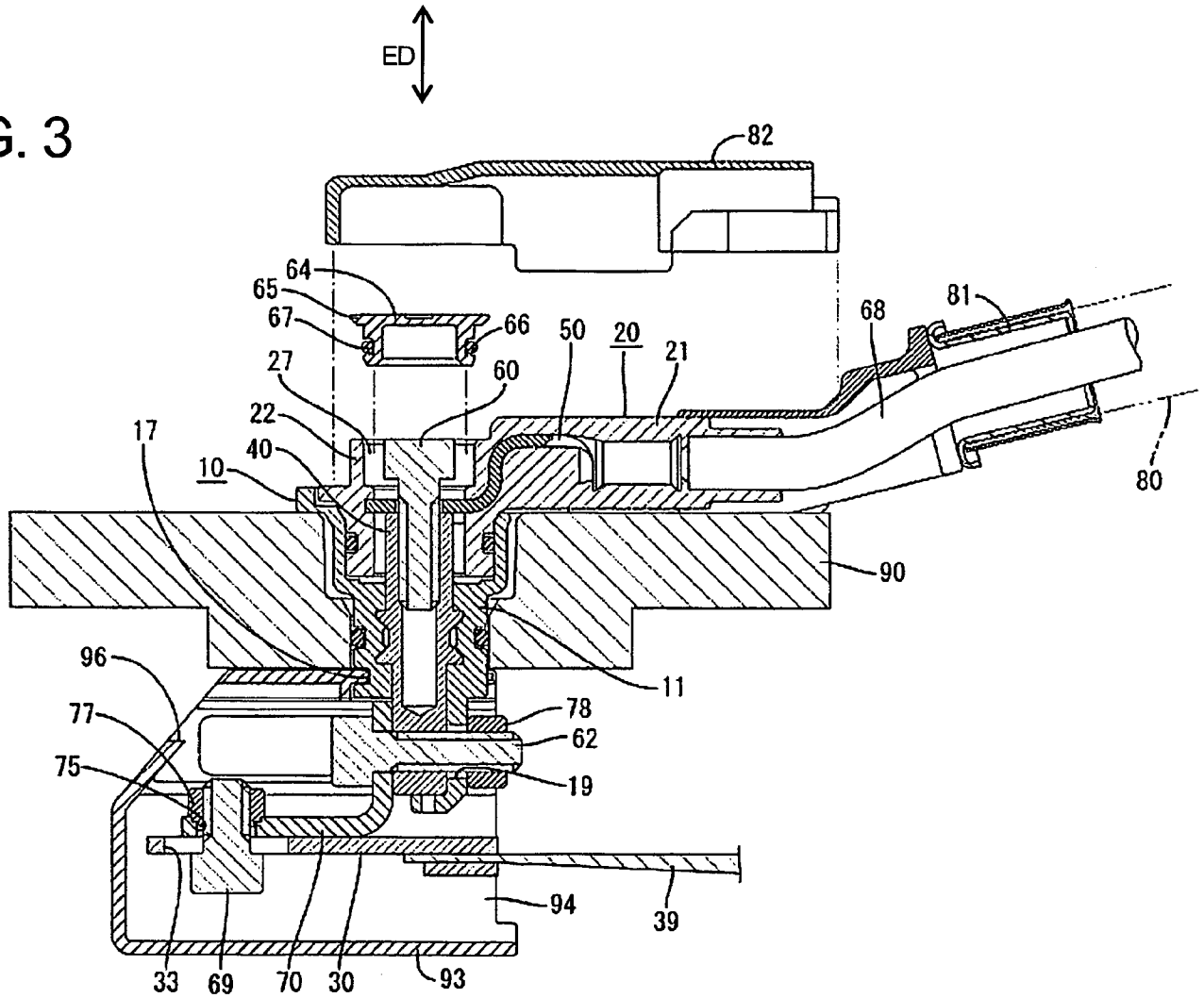
FIG. 3 is a side view in section showing a state where the movable side housings are fixed to the waiting side housing by means of bolts.

The cover 93 is fit into the receiving grooves 17 of the mold portions 11 from the front and along the inner surface of the motor casing 90. Thus, the cover 93 is mounted on the intermediate terminals 40 while separating and insulating electrodes. The movable side housings 20 then are assembled from above and along the extension direction ED, as shown in FIGS. 1 and 2. Upon connection, the fittings 22 enter and close the corresponding fitting recesses 12. Thus, the housings 10, 20 are positioned and connected while having loose radial movements prevented. Simultaneously, the contacts 51 of the power feed terminals 50 contact the power-feed side contacts 42 of the intermediate terminals 40. As a result, the bolt insertion holes 56 of the power feed terminals 50 align with the tightening holes 41 of the intermediate terminals 40. Thereafter, as shown in FIG. 3, the other bolts 60 are inserted through the open upper end surfaces of the fitting recesses 12 into the bolt insertion holes 56 and the tightening holes 41 and engage spirally with the inner surfaces of the tightening holes 41. Upper surfaces of the heads of the tightened bolts 60 are at substantially the same height as the open upper end surfaces of the fittings 22.

Figure 4:
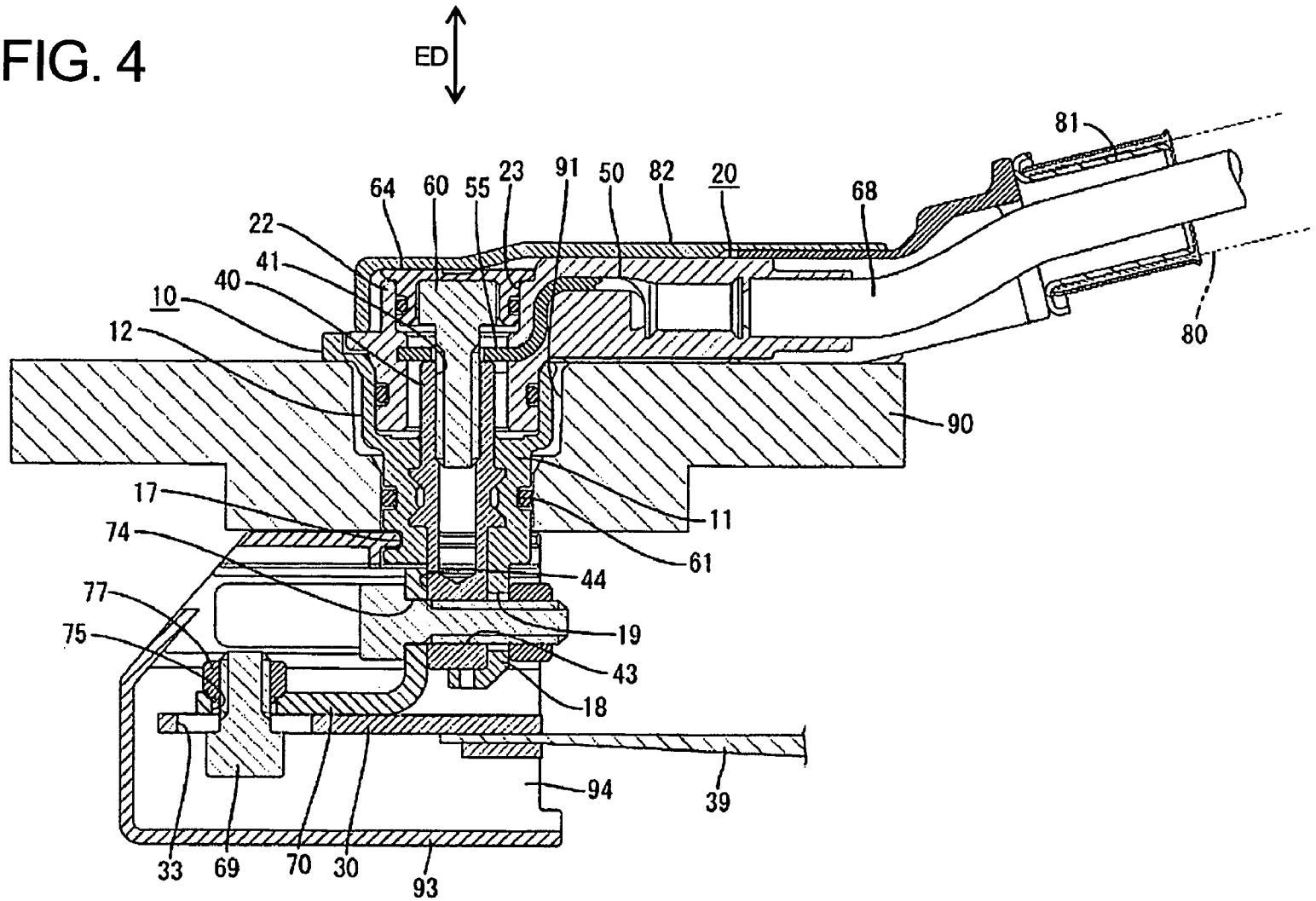
FIG. 4 is a side view in section showing a state where the movable side housings are completely assembled with the waiting side housing.

Thereafter, as shown in FIG. 4, the caps 64 are mounted on the fittings 22 from above to surround the heads of the bolts 60. Further, the movable side housings 20 are mounted on the outer surface of the motor casing 90 by tightening bolts through bolt holes (not shown) of the shielding shell 82 and the shielding shell 82 is connected electrically with the motor casing 90.

In the assembled state, the seal ring 61 on the outer surface of the waiting side housing 10*a* provides a fluid tight fit between the mount hole 91 of the motor casing 90 and the waiting side housing 10. Similarly the seal rings 63 on the outer surfaces of the fitting portions 22 provide fluid tight fits between the fitting recesses 12 and the fittings 22. Further, the seal rings 67 on the outer surfaces of the caps 64 provide fluid tight fits between the fittings 22 and the caps 64. Therefore, fluid and/or oil will not leak between these members.

As described above, the intermediate terminals 40 are interposed between the motor side terminals 30 and the power feed terminals 50. The intermediate terminals 40 are held in the waiting side housing 10 and the power feed terminals 50 are held in the movable side housings 20. The contacts 51 of the power feed terminals 50 are placed on the power-feed side contacts 42 of the intermediate terminals 40 as the housings 10, 20 are connected, thereby aligning the bolt insertion holes 56 and the tightening holes 41 with each other. Thus, the contact positions of the intermediate terminals 40 and the power feed terminals 50 are positioned before the bolts 60 are inserted through the holes 41, 56.

Therefore, the succeeding bolt tightening operation can be performed smoothly in the operation spaces 27 of the fitting recesses 12.

Each motor side terminal 30 has the oblong hole 33 for the bolt 69 in the area where the busbar 70 is placed. The oblong hole 33 extends toward and away from the intermediate terminal 40 and normal to the extension direction ED. Since the connected position of the motor side terminal 30 and the busbar 70 is adjustable within the formation range of the oblong hole 33, the motor side terminal 30 and the intermediate terminal 40 can be connected securely with high reliability via the busbar 70 even if the motor side terminal 30 and the intermediate terminal 40 are displaced due to a dimensional error.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the oblong holes are in the motor side terminals in the foregoing embodiment, they may be in the busbars according to the invention.

The busbars are interposed between the intermediate terminals and the motor side terminals in the foregoing embodiment. However, the motor side terminals may be connected directly with the motor side contacts of the intermediate terminals according to the invention.

The motor conductor is drawn out from the same side as the power feed cable in the foregoing embodiment. However, the invention also is applicable to the case where the motor conductor is drawn out in a direction opposite to the power feed cable. In this case, the mounting direction of the cap may be substantially opposite to the one of the foregoing embodiment.

The mountings project sideways from opposite lateral ends of the coupling in the foregoing embodiment. However, projecting directions of the mounts from the coupling can be set differently.

Conductor paths by the power feed cables are shielded in the foregoing embodiment. However, the invention is also applicable to the case where the conductor paths by the power feed cables are not shielded.

Oblong holes in the busbars compensate for dimensional errors of the motor side terminals and the busbars in the foregoing embodiment. However, dimensional errors may be compensated for by forming the busbars and the motor side terminals by plural members and changing the combinations of these members.

Plural intermediate terminals are held together in one waiting side housing 10 via the coupling in the foregoing embodiment. However, one waiting side housing may hold only one intermediate terminal.

What is claimed is:

1. An electrical connection construction for connecting at least one power feed terminal with at least one motor side terminal, comprising:

a movable side housing formed from resin that is insert molded around the power feed terminal so that an intermediate portion of the power feed terminal is surrounded by a unitary matrix of the resin for holding the power feed terminal;

a waiting side housing connectable with the movable side housing;

at least one intermediate terminal in the waiting side housing, the intermediate terminal having a motor side contact for connection with the motor side terminal and at least one power-feed side contact contacting a contact of the power feed terminal when the waiting side housing is connected with the movable side housing; and at least one fastener inserted through the power-feed side contact and the contact of the power feed terminal to fix the power feed terminal and the intermediate terminal to each other.

2. The electrical connection construction of claim 1, wherein the waiting side housing is mounted to a motor casing and has a connection surface exposed externally on the motor casing.

3. The electrical connection construction of claim 1, wherein at least one through hole penetrates the movable side housing in a connecting direction of the housings, and the contact of the power feed terminal being arranged at an intermediate position of the through hole along the connecting direction.

4. The electrical connection construction of claim 3, wherein an operation space surrounds the through hole remote from the waiting side housing to provide access for operating the fastener.

5. The electrical connection construction of claim 1, wherein the waiting side housing is formed from resin that is insert molded around the intermediate terminal so that an intermediate portion of the intermediate terminal is surrounded by a unitary matrix of the resin.

6. The electrical connection of claim 1, wherein the motor side terminal is connected with the motor side contact portion of the intermediate terminal via at least one busbar, and at least one of the motor side terminal and the busbar includes a compensating portion that compensates for relative displacements while the busbar is fixed to the intermediate terminal.

7. The electrical connection construction of claim 1, wherein the motor side terminal and the busbar are formed with insertion holes for receiving a second fixing member, at least one of the insertion hole being oblong and having a long dimension extending in directions substantially towards and away from the intermediate terminal to compensate for relative displacements while the busbar is fixed to the intermediate terminal.

* * * * *